United States Patent [19]

Seragnoli

[11] 4,304,243

[45] Dec. 8, 1981

[54] TRIMMER DEVICE FOR THE TOBACCO FILLER IN A CIGARETTE MANUFACTURING MACHINE

[75] Inventor: Enzo Seragnoli, Bologna, Italy

[73] Assignee: G.D. Societa per Azioni, Bologna, Italy

[21] Appl. No.: 149,001

[22] Filed: May 12, 1980

[30] Foreign Application Priority Data

Feb. 11, 1980 [IT] Italy ..... 47859 A/80

[51] Int. Cl.[3] ..... A24C 5/14; A24C 5/18

[52] U.S. Cl. ..... 131/84 C

[58] Field of Search ..... 131/84 C, 906

[56] References Cited

U.S. PATENT DOCUMENTS 3,338,247 8/1967 Labbe ..... 131/84 C
4,210,159 7/1980 Quarenghi ..... 131/84 C

FOREIGN PATENT DOCUMENTS 2037534 2/1979 Fed. Rep. of Germany .... 131/84 C
1314825 4/1973 United Kingdom ..... 131/84 C
1314826 4/1973 United Kingdom ..... 131/84 C

*Primary Examiner*—V. Millin
*Attorney, Agent, or Firm*—Merriam, Marshall & Bicknell

[57] ABSTRACT

In a cigarette manufacturing machine, the trimmer device for the tobacco filler comprises two cone frustum trimming discs which are tangential to each other at their major base, this latter being provided with a cutting edge, and are mounted on inclined shafts which converge downwards. The cone-frustum surfaces of said discs are provided with equidistant grooves, of which the pitch, measured along the cutting edge, is equal to the length of the cigarettes under production, and their radial dimensions are a function of this length. Structure is provided for setting the position of said discs on their respective shafts according to their diameter, and additional structure is provided for setting the position of the trimmer device relative to the tobacco filler. A rotating brush is also provided cooperating with said discs in the trimming zone, and structure for setting the position of said brush relative to said discs.

7 Claims, 6 Drawing Figures

Fig.1
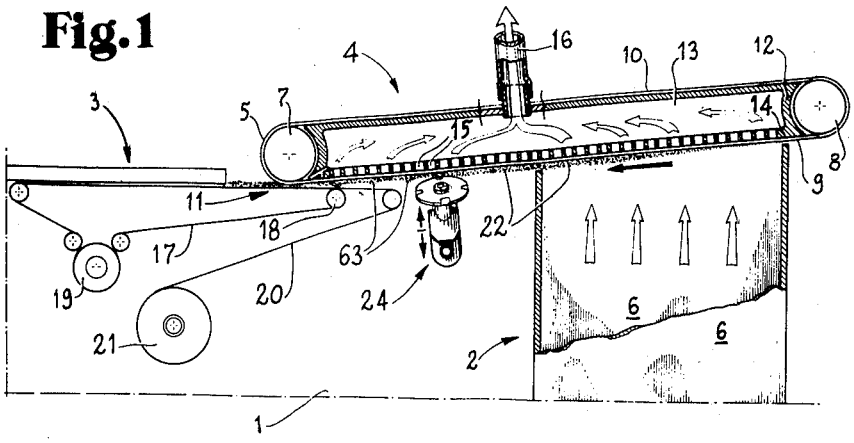
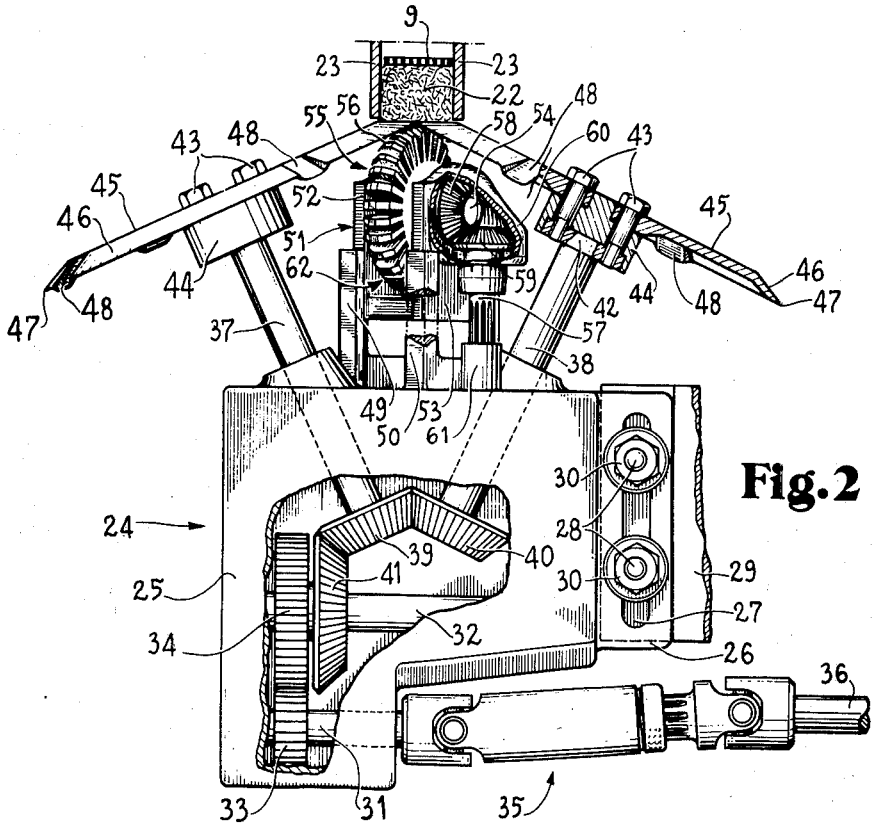
Fig.2

TRIMMER DEVICE FOR THE TOBACCO FILLER IN A CIGARETTE MANUFACTURING MACHINE

BACKGROUND OF THE INVENTION

This invention relates to a trimmer device for the tobacco filler in a cigarette manufacturing machine. In cigarette manufacturing machines of the continuous rod type, a tobacco filler or layer is formed by accumulating individual particles of tobacco on a support constituted by a conveyor belt driven with continuous motion.

During its transfer by said belt to the means for forming the individual cigarettes, the tobacco filler is subjected to a so-called trimming operation, the purpose of which is to make it substantially constant in height or thickness.

The means used for this purpose, known as trimmers, are frequently constituted (see for example British Pat. No. 881,024) by two counter-rotating equal discs of vertical axis provided with cutting edges which are tangential to each other along the path of the tobacco filler.

The trimming operation is completed by a rotating brush disposed in proximity to the zone of tangency between the two discs, and on the opposite side to the tobacco filler. The purpose of the rotating brush is to remove from said zone of tangency those tobacco particles which become separated from the filler by the action of the two discs.

The cutting contours of the two trimming discs are normally provided with recesses having their concavity facing the tobacco filler and equidistant from each other, with a pitch equal to the length of one cigarette (again see for example British Pat. No. 881,024). When the trimming discs are correctly phased relative to each other, cutting contours of the aforesaid type generate a tobacco filler in which portions of two different thicknesses alternate.

The portions of greater thickness, generated by the recesses in the two discs meeting each other along the path of the tobacco filler, produce zones of greater tobacco density in the so-called continuous cigarette rod, i.e. after wrapping the filler in the cigarette paper web.

The cutting device operates in these zones to divide the rod into individual cigarettes having a greater tobacco density at their ends than in their middle.

The purpose of these dense portions is to prevent or at least limit the escape of tobacco particles from the ends of the cigarettes during the various processing stages (application of filters, transfer, packaging) to which they are subjected.

From the aforegoing, it follows that the pitch of said zones of greater tobacco density must be changed each time it is necessary to change over from producing cigarettes of one determined length to producing cigarettes of a different length, or in other words when it is required to vary the type of production in a manufacturing machine.

In the described devices of known type, when the trimming discs are replaced by others of a different diameter provided with recesses disposed at the required pitch, it is necessary to move the vertical shafts of the two discs relative to each other in order to restore the condition of tangency between the cutting edges.

This is done by replacing gears in the kinematic chain of the device, and/or by delicate setting operations. In order to avoid said replacements and settings, it is also known to replace the trimmer device completely.

Although advantageous relative to the former by virtue of its practical aspect and speed, this latter system is obviously inconvenient cost-wise.

SUMMARY OF THE INVENTION

The object of the present invention is therefore to provide a trimmer device for the tobacco filler in cigarette machines which can be adapted to the production of cigarettes of any length having a higher tobacco density at their ends more rapidly and economically than similar devices of known type.

These and further objects are all attained by the trimmer device for the tobacco filler in a cigarette manufacturing machine, characterised by comprising, in combination, a pair of equal counter-rotating discs with an external cone-frustum surface having a cutting edge at the major base, the discs being mounted on downwardly converging inclined shafts supported by a common support and defining a plane substantially normal to the path of said filler, said discs being disposed so that said cutting edges are substantially tangential to each other and with one of their generating lines substantially aligned with the path of said tobacco filler, said cone-frustum surfaces comprising recesses or grooves directed substantially along their generating lines and spaced apart along said cutting edges by a pitch substantially equal to the length of the cigarettes produced by said manufacturing machine, such that the diameter of said discs, for a like number of said recesses, is a function of the length of said cigarettes, there being provided means for setting said discs on their respective shafts in a position which is a function of said diameter, and means for setting the level of said support relative to the base of said manufacturing machine.

BRIEF DESCRIPTION OF THE DRAWINGS

Further characteristics and advantages will be more apparent from the detailed description given hereinafter of two embodiments of the device according to the present invention, illustrated by way of non-limiting example in the accompanying drawings in which:

FIG. 1 is a partial diagrammatic view of a cigarette manufacturing machine provided with the device according to the invention;

FIG. 2 is a first embodiment of the device according to the invention;

DETAILED DESCRIPTION OF THE INVENTION

Figure 3:
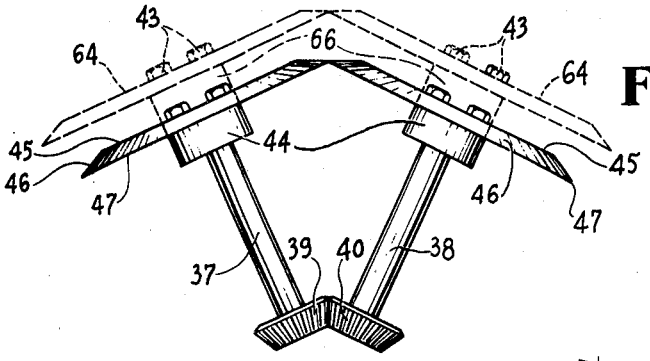
FIGS. 3, 4 and 5 are some details of the device according to the invention.

With reference to FIG. 1, the reference numeral 1 indicates the base of a continuous rod machine for cigarette production. Said manufacturing machine is divided into two parts, namely a substantially vertical duct indicated by 2, and a section indicated overall by 3 for forming a continuous cigarette rod, and then for producing individual cigarettes by a cutting operation.

The duct 2 and section 3 lie above and are connected to each other by a conveyor system indicated overall by 4, comprising a conveyor belt 5 permeable to air. The duct 2 has a rectangular cross-section, and is bounded to its front and rear by two walls 6.

The belt 5 is endless and passes over two equal end rollers indicated from left to right by 7 and 8, which rotate in a clockwise direction about horizontal axes normal to the walls 6.

Said rollers 7 and 8 are disposed in this order at an increasing level, so that the lower branch 9 and upper branch 10 of the belt 5 are inclined upwards from left to right. The lower branch 9 closes the outlet of the duct 2, and its left hand end extends as far as a position 11, namely the discharge position, at which the tobacco is fed to the section 3.

The lower branch 9 and upper branch 10 run along the perimeter of a box member 12 defining a chamber 13 internally. The chamber 13, bounded lowerly by a wall 14 traversed by bores or slots 15, communicates by way of a conduit 16, with suction means, not shown.

The discharge position 11 is placed at the meeting position of said belt 9 and the upper horizontal branch of an endless belt 17 passing around two end rollers 18 and driven by a roller 19 rotating anticlockwise. The reference numeral 20 indicates a web of cigarette paper unwinding from a spool 21, the web becoming disposed on the belt 17 immediately upstream of said discharge position 11.

When the cigarette manufacturing machine is in operation, means of known type, not shown, feed the lower end of the duct 2 with a continuous stream of tobacco particles. Under the thrust of a rising air current generated by a compressed air source, not shown, these particles rise up the duct 2 until they meet the branch 9 of the belt 5, by which they are retained due to the action of said suction means to which the chamber 13 is connected.

The tobacco layer or filler 22 which forms constantly under the belt 5 is conveyed thereby outside the duct 2, and is deposited on the paper web 20 in the discharge position 11. During this transfer, the tobacco layer 21 is bounded on its sides by two lateral walls 23 (FIG. 2) supported in a manner not shown.

A trimmer device indicated overall by 24 operates on the tobacco filler 22 in a position between said duct 2 and the discharge position 11.

A first embodiment of said trimmer device 24, illustrated in greater detail in FIG. 2, comprises a box member or support 25 supported by the base 1 of the manufacturing machine. An appendix 26 comprising a vertical slot or guide means 27 is fixed to a lateral wall of the box member 25.

This slot is traversed by two horizontal superposed threaded pins 28 rigid with a support element 29 supported by the base 1 of the manufacturing machine. Nuts 30 for fixing the box member 25 to the support element 29 are screwed on to the end of the pins 28. By simply slackening said nuts 30, which together with the pins 28 and slot 27 constitute means for setting the level of said support 25, the position of this latter relative to the base 1 can be varied vertically.

The box member 25 supports internally two superposed horizontal shafts, the lower one indicated by 31 and the upper one by 22. Two mutually engaged gear wheels 33 and 34 are respectively keyed thereon.

The shaft 31 emerges from the box member 25 through a lateral wall, and is connected to a drive shaft 36 by transmission means comprising an extendable shaft and a double articulated coupling indicated overall by 35.

Two shafts indicated from left to right by 37 and 38 emerge from the upper wall of the box member 25, and are disposed in the same vertical plane as the shafts 31 and 32 such that they converge at a point situated on the axis of the shaft 32. The lower ends of said shafts 37 and 38 support respective mutually engaged bevel gears 39 and 40. The gear 39 is engaged with a bevel gear 41 rigid with the shaft 32.

Said shafts 37 and 38, of which the described mechanical members contained in the box member 25 constitute the drive means, terminate upperly with flanges 42 (of which only that relative to the shaft 38 is visible), to which respective trimming discs 45 are fixed by screws 43, by way of spacers or setting means 44. These trimming discs are bounded externally by a cone-frustum surface 46 comprising a cutting edge 47 along their major base, and are disposed with the cutting edges 47 substantially tangential to each other.

Their cone-frustum surfaces 46 are in contact, substantially along a generating line, with the lower surface of the tobacco filler 22. The cone-frustum surfaces 46 of the discs 45 are provided with recesses or grooves 48 which are directed along the generating lines, and are equidistant at a pitch substantially equal to the length of one cigarette.

The upper wall of the box member 25 supports two vertical rails or guide means indicated from left to right by 49 and 50, and disposed between the shafts 37 and 38.

A U-shaped slide 51 is slidably mounted between the guide means 49 and 50 (see FIG. 2).

The two vertical portions or uprights of said slide 51 in contact with the guide means 49 and 50 are constituted respectively by plates 52 and 53 lying in parallel planes and disposed obliquely to the feed direction of the tobacco filler 22. A spindle 54 normal to the plates 52 and 53 is rotatably supported thereby in proximity to their upper end.

Figure 6:
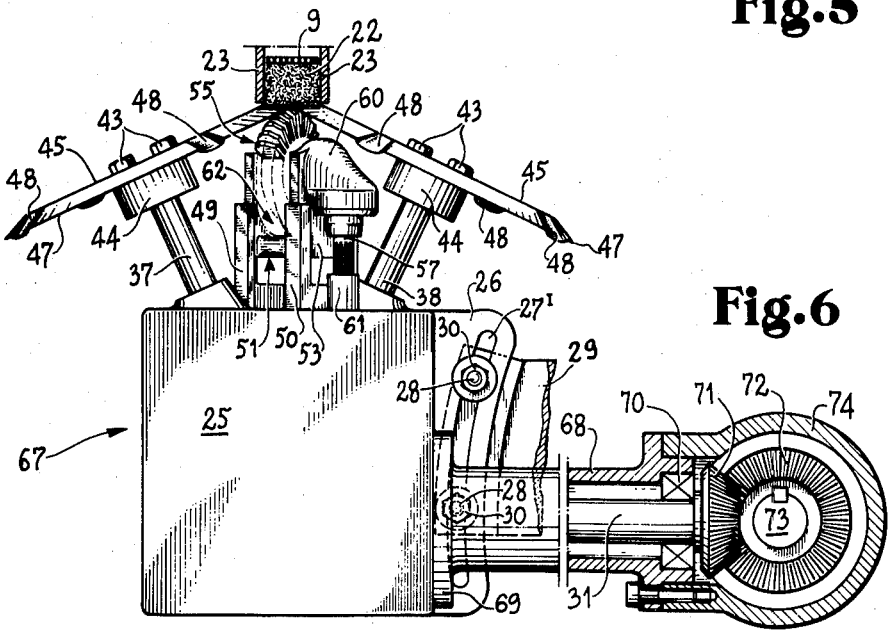
FIG. 6 is a second embodiment of the device according to the invention.

A rotating brush is keyed on to said spindle 54 between the two plates 52 and 53. This brush can be constituted in known manner either by a cylindrical bristle brush, or, as shown in FIGS. 2 and 6, by a wheel 55 fitted with radial blades 56, the ends of which graze the discs 45 at their zone of tangency.

The right hand end of the spindle 54 which emerges from the plate 53 is connected to a vertical spindle 57 by a bevel gear pair 58 and 59 contained in a box 60 rigid with the plate 53. The spindle 57 is mounted to slide vertically in a sleeve 61 which emerges from the upper wall of the box member 25, and is driven by the shaft 31 in a manner not shown.

If the device according to the invention uses a bladed wheel 55, then in order to prevent interference with the discs 45, the wheel is provided with a bevel 62 along its periphery, and is set relative to the discs 45 such that the recesses 48 and bevel 62 reach said zone of tangency of the discs 45 in synchronism with each other.

When the shaft 36 is operated by means of the kinematic chain comprising the transmission means 35, the shaft 31, the gear wheels 33 and 34, the shaft 32, the bevel gears 41, 39 and 40, and the shafts 37 and 38, it rotates the discs 45 in opposite directions. In known manner, and as stated heretofore, the tobacco filler 22 leaving the duct 2 is acted upon by the trimming discs 45 provided with the recesses 48.

The result is a tobacco filler formed from portions of substantially uniform thickness which alternate, at a pitch equal to the length of one cigarette (for example equal to L1), with portions of greater thickness indicated by 63 in FIG. 1. After wrapping said filler 22 in a cigarette paper web in order to form the so-called continuous cigarette rod, the portions 63 of greater thickness are cut in order to form cigarettes of length L1 having a greater tobacco density at their ends than in their middle.

Figure 4:
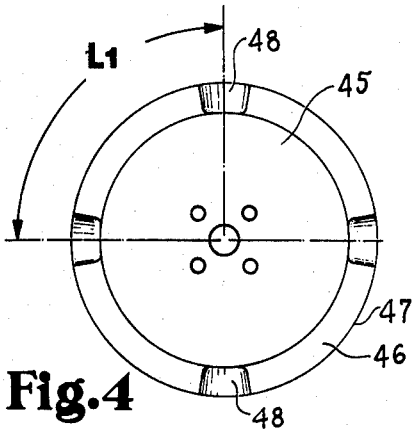

It will be now assumed that the manufacturing machine set for producing cigarettes of length L1 and thus fitted with the trimming discs 45 shown in FIGS. 3 and 4 requires to be adapted for producing cigarettes of length L2 greater than L1. The trimmer device according to the present invention is modified for this purpose in the following manner. After slackening the nuts 30, the box member 25 is moved downwards in order to separate the trimming discs 45 from the tobacco filler 22. The discs 45 and spacers 44 are then replaced.

Figure 5:
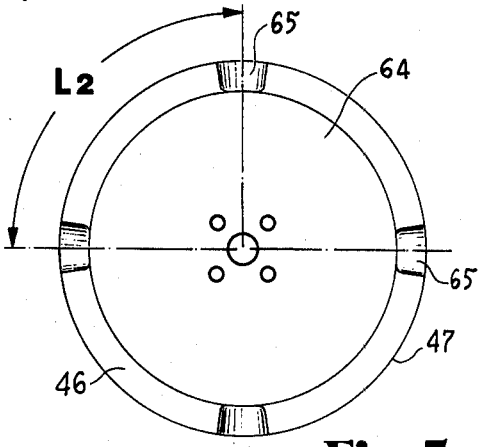

More precisely, the discs 45 are replaced by a pair of discs 64 of greater diameter (see FIGS. 4 and 5) provided along their periphery with recesses 65 at a pitch equal to the length L2. The new discs 64 are mounted on the respective shafts 37 and 38 by way of spacers 66 having a thickness such as to ensure that the cutting edges 47 are tangential to each other. The box member 25 is then set relative to the support element 29 such that the two discs 64 are in contact with the filler 22. Finally, in order to keep the rotating brush in contact with said tangency zone, the brush is set in a vertical direction by adjustment means comprising the slide 51 rotatable on the guide means 49 and 50, together with operating and locking means, which are not shown in the figures as they are of conventional type. If the device 24 uses a bladed wheel 55, a further operation has to be carried out each time the discs 45 are replaced in order to preserve the correct phasing between the recesses 48 and bevel 62, namely the replacement for example of the gear wheels 33 and 34 by others having a determined transmission ratio. FIG. 6 shows a second embodiment of the device according to the invention, indicated overall by the reference numeral 67. The details common said device 67 and to the described device 24 of FIG. 2 are indicated by the same reference numerals.

The sleeve 68, connected to the box member 25 by a flange 69, supports the shaft 31 by way of bearings 70 (only one of which is shown in FIG. 6). The shaft 31 and a bevel gear pair 71 and 72 constitute the motion transmission means between a horizontal drive shaft 73 normal to the shaft 31, and the operating means for the discs 41.

The gear wheel 72 and shaft 73 are contained in a sleeve 74 fixed to the sleeve 68 and connected to the base 1 of the manufacturing machine, and free to rotate about its axis. The straight vertical slot 27 of the first embodiment is indicated in the device 67 of FIG. 6 by 27', and is in thus case curved in the form of an arc of a circle with its centre of curvature on the axis of the shaft 73.

The box member 25 is therefore set by slackening the nuts 30 and then rotating it about the axis of the shaft 73 until the required engagement condition between the bevel gears 71 and 72 is attained. It should be noted that this type of setting does not enable the discs 45 to be kept in contact with the tobacco filler 22 along a horizontal plane in every case. In this respect, this optimum situation can only occur for a single position of the device 67, and the variation from the ideal trimming condition for the filler 22 will be greater the greater the extent that the device 67 is rotated from this position. However, it has been found that if the device 67 is suitably dimensioned and the range of adjustment is kept within convenient limits which are normally sufficient for the requirements of cigarette manufacturing machines, the operation of the discs 45 can be considered as perfectly satisfactory.

What we claim is:

1. A trimmer device for the tobacco filler in a cigarette manufacturing machine, characterised by comprising, in combination, a pair of equal counter-rotating discs with an external cone-frustum surface having a cutting edge at the major base, the discs being mounted on downwardly converging inclined shafts supported by a common support and defining a plane substantially normal to the path of said filler, said discs being disposed so that said cutting edges are substantially tangential to each other and with one of their generating lines substantially aligned with the path of said tobacco filler, said cone-frustum surfaces comprising recesses or grooves directed substantially along their generating lines and spaced apart along said cutting edges by a pitch substantially equal to the length of the cigarettes produced by said manufacturing machine, such that the diameter of said discs, for a like number of said recesses, is a function of the length of said cigarettes, there being provided means for setting said discs on their respective shafts in a position which is a function of said diameter, and means for setting the level of said support relative to the base of said manufacturing machine.

2. A trimmer device as claimed in claim 1, characterised in that said support is constituted by a box member containing operating means for said discs, which are connected to a drive shaft supported by said manufacturing machine.

3. A trimmer device as claimed in claim 1, characterised in that said means for setting the level of said support comprise vertical means for guiding said support relative to said base, said operating means being connected to said drive shaft by transmission means comprising an extendable shaft with a double articulated coupling.

4. A trimmer device as claimed in claim 1, characterised in that said means for setting the level of said support comprise guide means in the form of an arc of a circle which allow said support to rotate about an axis substantially parallel to said tobacco filler, said operating means being connected to said drive shaft by transmission means comprising a bevel gear pair.

5. A trimmer device as claimed in claim 1, wherein said means for setting said discs on their respective shafts are constituted by spacers disposed between the upper ends of said shafts and said discs.

6. A trimmer device as claimed in claim 1 and comprising a brush rotating about a horizontal axis and tangential to the position of tangency of said discs on the opposite side to said tobacco filler, characterised by comprising means for vertically setting said brush relative to said support.

7. A trimmer device as claimed in claim 1, characterised in that said means for vertically setting said brush comprise a support slide for said brush, and guide means for said slide rigid with said support.

* * * * *